United States Patent [19]

Hatori

[11] 4,059,319

[45] Nov. 22, 1977

[54] VENDING MACHINE

[75] Inventor: Kunitake Hatori, Maebashi, Japan

[73] Assignee: Sankyo Electric Company Limited, Isesaki, Japan

[21] Appl. No.: 716,834

[22] Filed: Aug. 23, 1976

[30] Foreign Application Priority Data

Aug. 23, 1975 Japan ..... 50-116423[U]
Mar. 16, 1976 Japan ..... 51-30700[U]

[51] Int. Cl.[2] ..... A47B 88/00; A47B 95/00
[52] U.S. Cl. ..... 312/319
[58] Field of Search ..... 312/339, 340, 338, 333, 312/334–335, 348, 223; 248/51

[56] References Cited

U.S. PATENT DOCUMENTS

| | | | |
|---|---|---|---|
| 1,172,134 | 2/1916 | Harold | 248/51 |
| 1,315,922 | 9/1919 | Franklin | 312/341 R |
| 1,706,085 | 3/1929 | Straubel | 312/339 X |
| 2,379,157 | 6/1945 | Jones | 312/333 |
| 2,660,506 | 11/1953 | Wright | 312/319 X |
| 2,862,772 | 12/1958 | Gussack | 312/339 |
| 3,836,222 | 9/1974 | Kuntze | 312/319 |

FOREIGN PATENT DOCUMENTS

| | | | |
|---|---|---|---|
| 345,539 | 3/1931 | United Kingdom | 312/339 |

*Primary Examiner*—Paul R. Gilliam
*Assistant Examiner*—Victor N. Sakran
*Attorney, Agent, or Firm*—Hopgood, Calimafde, Kalil, Blaustein and Lieberman

[57] ABSTRACT

A vending machine having a plurality of article storage housing units which are removably mounted in the machine cabinet. Each of the housing units is slidably supported at the top and bottom ends by guide means to be smoothly drawable out of the machine cabinet. The machine is provided with releasable stopper means for preventing the movement of each housing unit loaded within the cabinet. It is performed after releasing the releasable stopper means to drawing the housing unit out of the cabinet. The machine is further provided with means for regulating electric cables connected to each housing unit to prevent the cables from being caught during the movement of said housing unit.

11 Claims, 9 Drawing Figures

VENDING MACHINE

BACKGROUND OF THE INVENTION

This invention relates to vending machines and, in particular, to article storage device in the machines.

Generally speaking, a vending machine has an article storage device from which articles are discharged for vending one article at a time when all articles stored in the article storage device have been vended, fresh articles are fed or loaded into the article storage device.

It is required in vending machines that a number of articles can be stored in the article storage device to decrease the number of times of article feeding, or loading, operation.

Moreover, the machines are desired to be small in the volume, while a number of articles can be stored.

Furthermore, it is required that the article feeding operation is easy and ready.

SUMMARY OF THE INVENTION

It is an object of this invention to provide a vending machine in which an increased number of articles can be stored with little increase of the volume of the machine.

It is another object of this invention to provide a vending machine which is simple and easy in the article feeding operation.

A yet another object of this invention is to provide a vending machine wherein an article storage device comprises a plurality of housing units. The housing units are mounted within a machine cabinet side by side and are smoothly drawable out of the machine cabinet. Therefore, a space within the machine cabinet is effectively used for storing articles to be vended and operations for loading or feeding fresh articles can be readily carried out by extracting or drawing out each housing unit from the machine cabinet.

A still another object of this invention is to provide a vending machine wherein a plurality of article storage housing units are slidably and drawably mounted in the machine cabinet and wherein releasable stopper means is provided to prevent each housing unit from freely moving. Accordingly, each housing unit is safely held within the machine cabinet even if the machine is inclined, and is able to be drawn out of the machine cabinet by releasing the releasable stopper means when required.

A further object of this invention is to realize above objects without being accompanied with such a disadvantage that electric cables connected to each housing unit are caught during movement of each housing unit.

According to this invention, a vending machine is obtained which comprises a cabinet with a front door and an article storage device mounted in the cabinet. The article storage device comprises at least one housing unit having a top end plate, a front end plate, and a rear end plate, and for storing articles to be vended therein. The housing unit is provided with an upper elongaged guide member and a lower elongated guide member which are fixed on the top end plate and at a lower side edge of the housing unit, respectively and extending from the front to the rear of said housing unit. The cabinet is provided with guide rail means extending within the cabinet from the front to the rear of the cabinet. On the guide rail means, slidable guide means is slidably supported movably along the guide rail means. The slidable guide means slidably supporting and guiding the upper elongated guide member of the housing unit to permit the housing unit moving into and out of the cabinet. The cabinet is provided with guide groove means extending within the cabinet from the front to the rear of the cabinet and receiving and slidably supporting the lower elongated guide member of the housing. The housing unit is provided with a hole in the top end plate in which a hooked end of a hooked lever is received to prevent the movement of the housing unit from the loaded condition of the housing unit. The hooked lever is pivotally mounted within the cabinet and above the housing unit to be able to pivotally rotate in a vertical plane. The housing unit is provided with releasing means to push out the hooked end of the hooked lever from the hole of the top end plate of the housing to permit the movement of the housing unit along the guide rail means and the slidable guide means. The releasing means is operated by a manually operated lever which is coupled with the releasing means and is exposed from the front end plate of the housing unit.

The slidable guide means may be provided with roller means by which the slidable guide means is anti-frictionally movable on the guide rail means, and by which the upper elongated guide member of the housing unit is supported anti-frictionally movable.

The guide rail means and the slidable guide means may be provided with means for limitting the movement of the slidable guide means along the guide rail means within an extent. Accordingly, it is prevented that the slidable rail means is out of the guide rail means at a time when the housing unit is drawn out of the cabinet.

The slidable guide means and the upper elongated guide member may be provided with releasable engaging means to prevent the upper elongated guide member from being out of the slidable guide means at a time when the housing unit is drawn out of the cabinet. Accordingly, it is safely performed to draw the housing unit out of the cabinet.

The cabinet may be provided with movable electric cable holder means within the cabinet to regulate the movement of the electric cables connected to the housing unit. When the housing unit is moved into or out of the cabinet, the movement of the electric cables is regulated not to be caught.

Further objects, features and aspects of this invention will be understood from following descriptions of embodiments of this invention referring to annexed drawings.

DETAILED DESCRIPTION OF PREFERRED EMBODIMENTS

Figure 1:
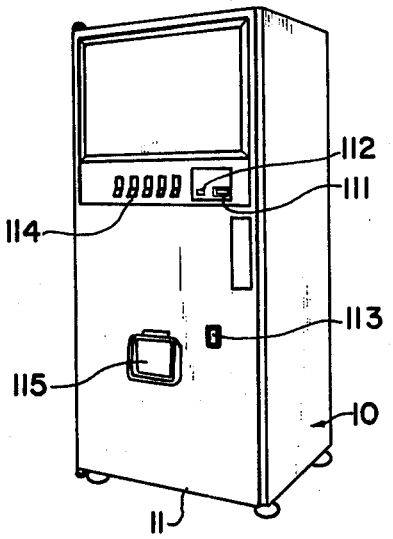
FIG. 1 shows a perspective view of an embodiment of a vending machine according to this invention.

Referring to FIG. 1 which shows a perspective view of an embodiment of this invention, the shown vending machine comprises a machine cabinet 10 with a front, or loading, door 11 which is hinged to the cabinet and selectively openable. The front door 11 is provided with a coin depositing opening 111, a manually operated lever 112 for returning deposited coin or coins, a coin returning opening 113 through which returned coins are obtained, article selecting buttons 114 (five buttons are shown) by which a desired kind of article is selected, and an access or delivery opening 115 through which a discharged article is obtained.

Figure 2:
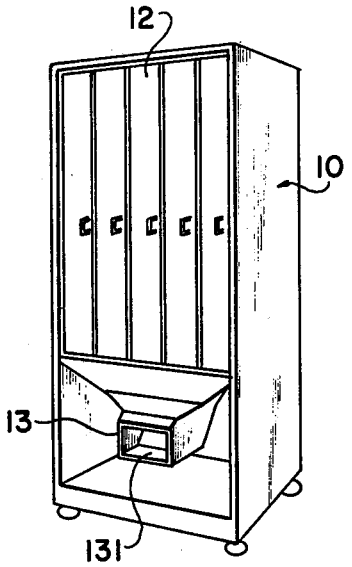
FIG. 2 shows a perspective view of a machine in FIG. 1, with a front door being disassembled.

Referring to FIG. 2 which shows a perspective view of the machine cabinet 10 with the front door 11 being disassembled, in the cabinet 10, housing units 12 for storing articles to be vended (five units are shown) are mounted side by side. Under the housing units 12, a downwardly sloping chute 13 is mounted, with a lower open end 131 thereof being matched to the access opening 115 of the front door.

The vending machine is provided with a coin mechanism, coin stoker and control circuits, but they are omitted simplification because this invention is not directed to them.

Each housing unit 12 is slidably mounted in the cabinet 10 to be smoothly and easily drawn out.

Figure 3:
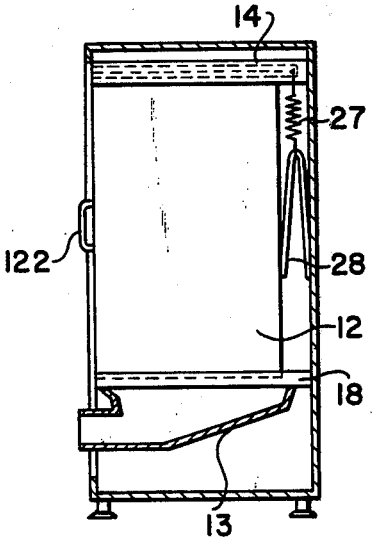
FIG. 3 shows a sectional view of the machine in FIG. 2.
Figure 4:
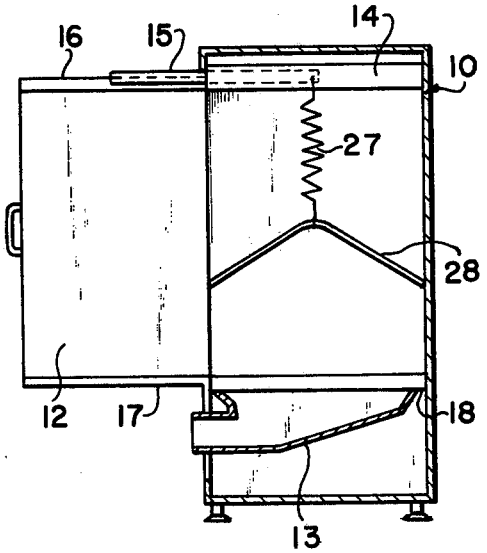
FIG. 4 shows a similar view as FIG. 3, at a condition that a housing unit is drawn out of a machine cabinet.
Figure 5:
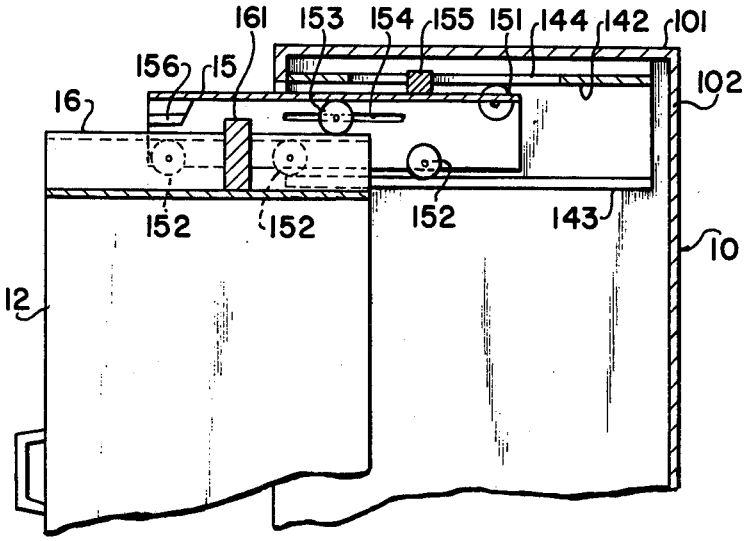
FIGS. 5, 6, and 7 illustrate a modified arrangement for slidably supporting the housing unit, FIG. 5 showing a sectional view at a condition that the housing unit is drawn out of the cabinet, FIG. 6 showing a front view, and FIG. 7 showing a sectional view on line A—A in FIG. 6.

Referring to FIGS. 3, 4 and 5, on an inner surface of a top board 101 of the machine cabinet 10, guide rails 14 are fixedly disposed for guiding respective unit devices 12 and extend in parallel with one another and between the front end and the rear plate 102 of the cabinet. Only one guide rail is shown in FIGS. 3 and 4 together with a corresponding one housing unit 12.

A slider 15 is slidably supported by the guide rail 14 to be movable along the guide rail 14.

The housing unit 12 is provided with an upper guide member 16 on the top surface of the housing and a lower guide member 17 at the bottom end of the housing unit.

The upper guide member 16 is slidably supported by the slider 15 and is slidably moved along the slider 15.

The lower guide member is received and slidably supported in a guide groove 18 which is mounted within the cabinet 10.

Accordingly, the housing unit is slidably mounted within the cabinet 10 and is able to be drawable out of the cabinet by drawing a handle of the housing unit.

Figure 6:
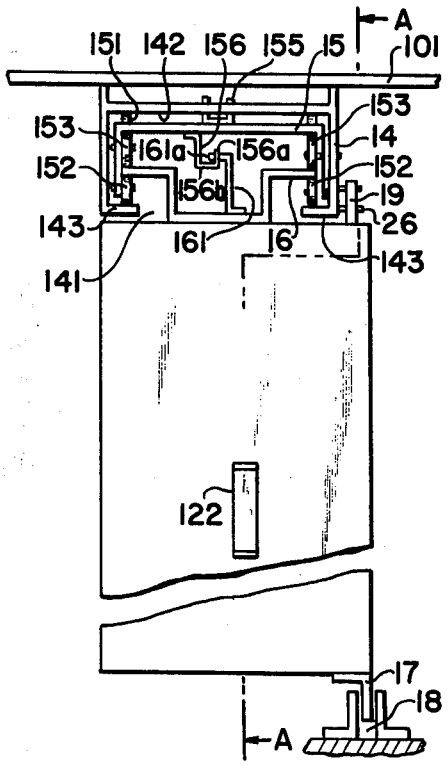

Referring to FIGS. 5 and 6, in which a preferred arrangement for slidably mounting the housing unit within the cabinet is shown in detail, the guide rail 14 is formed in a rectangular cylindrical form but is formed with an elongated slot 141 facing the unit device 12 and extending along the guide rail. A slider 15 is mounted anti-frictionally slidable in the guide rail 14. This is realized by the provision of a pair of rollers 151 which engage with and run along the upper inner surface 142 of the rail 14 and three pairs of rollers 152 which engage with and run along inner surfaces of two lower plate portions 143 which define the elongated slot 141.

The slider 15 is also provided with a pair of rollers 153 for guiding support plates 16 of the unit device 12 in cooperation with the three pairs of rollers 152.

The housing unit 12 is provided with two elongated supports, or guides, 16 with L-shape section which are fixedly mounted on the upper surface of the housing unit in such fashion that L-shape is inverted. Two L-shaped supports 16 may be integrally formed with a sheet of plate by bending process, as shown in the drawing.

The supports 16 are disposed between the rollers 153 and the rollers 152 to be slidably guided.

Accordingly, the housing unit is slidably mounted in the cabinet, and is smoothly drawable out of the cabinet.

The slider 15 is formed in an elongated member with a C-shape section, as shown, and all rollers are rotatably mounted on opposite side walls of the slider. The pair of rollers 153 for guiding the L-shape supports 16 are so mounted on the side walls that shafts of the rollers may be movable along the slider over a limited extent as shown by slots 154, in which the shafts are engaged respectively.

Furthermore, the housing unit device 12 is provided with an elongated guide plate 17 on the bottom surface, and near the side edge, if the housing unit is provided with a bottom opening for discharging articles, as shown in FIG. 6. The guide plate 17 is inserted or received in a guide groove 18 which is formed on a machine frame 102 so that the unit device 12 is prevented from the undesired lateral pendulous movement.

In the upper surface 142 of the guide rail 14, an elongated slot 144 is formed, into which a projection 155 is slidably fitted. The projection 155 is fixedly mounted on the slider 15. Therefore, the movement of the slider 15 along the guide rail 14 is limitted within an extent defined by the length of the slot 144. This is to prevent the slider 15 from disengaging from the guide rail 14 from the the front end of the guide rail when the housing unit is drawn out of the cabinet 10.

On the top of the housing unit, a projection 161 is provided. In the shown embodiment, the projection 161 is fixed to the connecting portion of the two L-shaped supports 16. The projection 161 engages with another projection 156 fixedly mounted on the slider 15 when the housing unit 12 is drawn out of the cabinet. Therefore, this prevents the supports 16 from disengaging with the slider 15 from the front end of the slider.

Therefore, such a danger is removed that the housing unit 12 falls off when the housing unit is drawn out of the cabinet.

The projection 161 is formed in an inversed L-shape and the another projection 156 is formed in an L-shape. These projections 161 and 156 are so arranged that the foot portion **161*a* of the "L" of the projection 161 engages with a vertical tab 156*a* which is provided at an end of a foot portion 156*b* of the "L" of the projection 156, as shown in FIG. 6. Therefore, if the housing unit is raised and drawn, the foot portion 161*a* of the projection 161 can pass over the vertical tab 156*a*. Thus the engagement of the projection 161 with the another projection 156 is released so that the housing unit 12 can be taken out of, or removed from, the cabinet. When loading the housing unit 12 into the cabinet, the housing unit is raised to permit the projection 161 of the unit passing over the projection 156 of the slider 15** and is pushed. Thereafter the housing unit is slidingly moved into the cabinet.

In the embodiment, the article feeding or loading operation is readily carried out by drawing the housing unit out of the cabinet. Alternatively, an empty housing unit may be replaced by a new similar housing unit in which articles are loaded.

Figure 7:
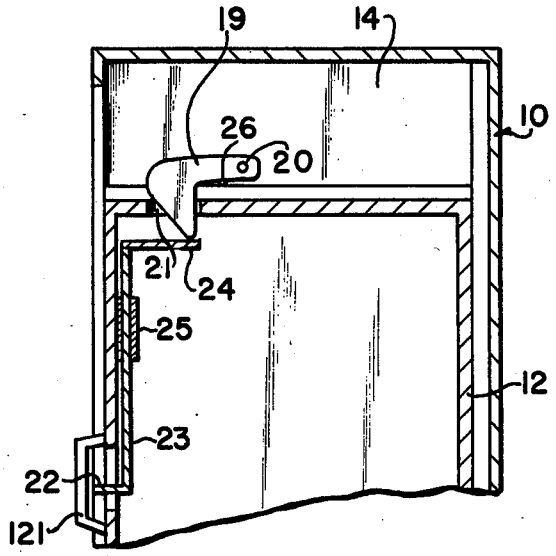

Referring to FIGS. 6 and 7, the shown embodiment is provided with a releasable stopper to hold the housing unit at the loaded condition within the cabinet.

A hooked lever 19 is pivotally mounted on a side end plate of the guide rail 14. A hooked end of the lever 19 is pivotable about a pivot 20 in a vertical plane. On the top plate of the housing unit 12, a hole 21 is formed to receive the hooked end of the lever 19 when the housing unit 12 is in a loaded condition within the cabinet. Thus, the housing unit 12 is prevented from slidably moving from the fully loaded condition so that the unit 12 will not inadvertently roll out from the cabinet 10 when the front door 11 is removed or opened, even if the cabinet 10 is mounted at an incline to its supporting surface.

The housing unit 12 is provided with a lever 22 exposed from the front plate 121 of the housing unit. The lever 22 is connected to a rod 23 which vertically extends along the inner surface of the front plate 121. A plate member 24 is connected to the upper end of the rod 23 and is disposed beneath the hole 21. The rod 23 is slidably supported by a support or guide member 25 which is fixed to the inner surface of the front plate 121. Accordingly, the lever 22, the rod 23 and the plate member 24 are vertically movable together.

When the lever 22 is pushed upwardly, the plate member 24 is also pushed up to push off the hooked end of the lever 19 from the hole 21. Thus, the engagement of the housing unit 12 with the hooked lever 19 is released so that the housing unit 12 is in a drawable condition.

In FIG. 7, a pin 26 is for preventing the hooked end of the hooked lever 19 to be pendant when the housing unit 12 has been drawn out of the cabinet 10. The pin 26 is also fixed to the side end plate of the guide rail 14. If the pin 26 is not provided, the hooked end of the lever 19 does not ride on the top plate of the housing unit 12 when the housing unit is again mounted within the cabinet so that the housing unit cannot be held in the loaded condition.

If the housing unit is provided with article discharging means, mechanical power source such as an electric motor for discharging articles, and other electrically operated parts, electric cables are connected to the housing unit for giving or feeding electric control signals and/or an electric power.

In such a case, when the housing unit is slidingly moved, the electric cables are moved together with the movement of the housing. As a result, the cables are sometimes caught by the housing unit, machine frame or other parts within the cabinet. This results in damage of cables.

Back to FIGS. 3 and 4, a coil spring 27 is supported at the rear end of the slider 15. At the lower end of the coil spring 27, the electric cable 28 is supported or held. At the loaded condition of the housing unit 12 as shown in FIG. 3, the cable 28 is given a tension by the coil spring 27 without loosening. When the housing unit 12 is drawn out of the cabinet, the slider 15 and the coil spring 27 is moved toward the front of the cabinet. At the same time, the electric cable 28 is also moved with the movement of the housing unit. Therefore, the coil spring 27 is extended so that the cable is still given a tension, as shown in FIG. 4. Thus, the cable 28 is always maintained without loosening, so that it is prevented that the cable is caught by the housing unit, machine frame or other parts when the housing unit is moved.

Figure 8:
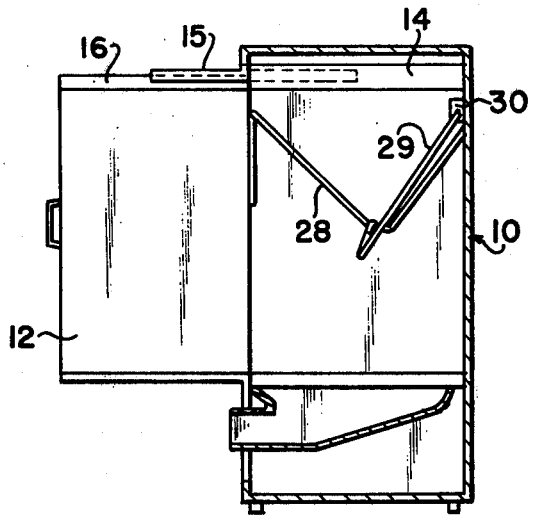
FIG. 8 shows a similar view as FIG. 4, for illustrating an embodiment with a different electric cable holder.
Figure 9:
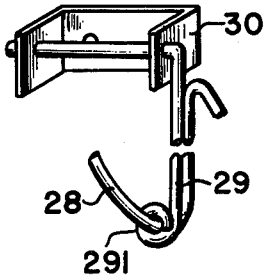
FIG. 9 shows a perspective view of the electric cable holder in FIG. 8.

FIGS. 8 and 9 shows another arrangement for regulating the movement of the electric cable 28. Referring to FIGS. 8 and 9, a lever 29 is supported by a support member 30 to be able to pivot in a vertical plane. The support member 30 is fixed on the inner surface of the rear plate of the cabinet 10. The free end of the lever 29 is formed in a ring 291.

The cable 29 is inserted through the ring 291 to be held. As a result, the cable 28 is always given a tension by the lever 29 because the lever 29 is given by gravity a torque by which the lower end ring 291 moves toward the lowest position thereof. Thus, the movement of the cable 28 together with the housing unit is regulated.

This invention has been described in connection with specific embodiments, it will be understood to those skilled in the art that various modifications and other designations are easily made within the scope of this invention.

What is claimed is:

1. In a vending machine including a cabinet with a front door and article storage means mounted within said cabinet, the improvement comprising:

at least one housing unit having a top end plate, a front end plate, and a rear end plate for storing articles to be vended, an upper elongated guide member fixed on the top end plate of said housing unit and extending from a front end to a rear end thereof, guide rail means mounted on an upper inside surface of said cabinet and extending from a front end to a rear end of said cabinet, slidable guide means being slidably supported along said guide rail means, said slidable guide means slidably supporting and guiding said upper elongated guide member to permit the movement of said housing unit into and out from said cabinet, guide groove means, mounted on a lower frame portion of said cabinet, extending from a front end to a rear end of said cabinet and positioned to receive and slidably guide said lower elongated guide member, stopper means for preventing said housing unit from being withdrawn from a loaded condition within said cabinet, said stopper means comprising a hooked lever means pivotally mounted in said cabinet above said housing unit when said housing unit is loaded therein and a hooked end of said hooked lever means being movable in a vertical plane about a horizontal axis to be freely pendant by gravity force, said hooked end being arranged to fall into and to be received in a hole formed in said top plate of said housing unit to prevent the withdrawal of said housing unit from a loaded condition within said cabinet, means for limiting the downward pendant movement of said hooked end of said hooked lever means to position a cammed surface of said hooked end for engagement with and for riding upon a top end plate of said housing unit in response to a loading operation of said housing unit into said cabinet, stopper releasing means provided in said housing unit for pushing said hooked end of said hooked lever means upwardly and out from said hole of said top end plate and said housing to release said stopper means, said stopper releasing means comprising a rod member mounted for free movement in the vertical direction between a lower rest position and an upper raised position, and a plate member provided at the upper end of said rod member, said plate member being disposed beneath said hole to urge said hooked end of said hooked lever means upwardly and out from said hole upon raising said plate member; and manually operated lever means coupled with said rod member of said stopper releasing means, said manually operated lever being exposed through the front end plate of said housing unit for operation from outside said housing means.

2. The improvement as claimed in claim 1, wherein said slidable guide means is provided with first roller means for running along and on said guide rail means, and second roller means for antifrictionally supporting said upper elongated guide member of said housing unit.

3. The improvement as claimed in claim 2, in which said guide rail means is formed with a slot of a limited length, said slidable guide means being provided with first projection which is slidably received in said slot, whereby the movement of said slidable guide means is limited within a distance defined by said limited length of said slot.

4. The improvement as claimed in claim 3, wherein said slidable guide means is provided with second projection, said housing unit being provided with third projection, said second projection being disposed to engage with said third projection when said housing unit is drawn out of said cabinet.

5. The improvement as claimed in claim 4, wherein the said second projection and said third projection is so arranged that the engagement is released by raising said housing unit, whereby said housing unit is able to be removed from said cabinet.

6. An improvement as claimed in claim 1, which further comprises electric cables extending within said cabinet and being connected to said housing unit to provide electric signal and electric power to electric parts in said housing unit, means for regulating the movement of said electric cables accompanied with the movement of said housing unit.

7. The improvement as claimed in claim 6, wherein said slidable guide means is provided with a coil spring at a rear end thereof, said coil spring supporting said electric cables at a lever end thereof to provide a tension said electric cables, whereby said electric cables are not laid idle.

8. The improvement as claimed in claim 6, wherein a cable holding lever is pivotally fixed to an inner wall of a rear plate of said cabinet to be pivotally rotatable in a vertical plane, said cable holding lever being provided with a ring at a free end thereof, said electric cables being inserted through, and supported by said ring, whereby said electric cables are given a tension by said cable holding lever not to be laid idle.

9. An improvement as claimed in claim 5, which further comprises electric cables extending within said cabinet and being connected to said housing unit to provide electric signal and electric power to electric parts in said housing unit, means for regulating the movement of said electric cables accompanied with the movement of said housing unit.

10. The improvement as claimed in claim 9, wherein said slidable guide means is provided with a coil spring at a rear end thereof, said coil spring supporting said electric cables at a lever end thereof to provide a tension said electric cables, whereby said electric cables are not laid idle.

11. The improvement as claimed in claim 9, wherein a cable holding lever is pivotally fixed to an inner wall of a rear plate of said cabinet to be pivotally rotatable in a vertical plane, said cable holding lever being provided with a ring at a free end thereof, said electric cables being inserted through, and supported by said ring, whereby said electric cables are given a tension by said cable holding lever not to be laid idle.

* * * * *